United States Patent [19]

Rowekamp

[11] 3,934,920

[45] Jan. 27, 1976

[54] CARRIAGE FOR LIFTING AND SPREADING ROWS OF ARTICLES

[75] Inventor: Edward F. Rowekamp, Cincinnati, Ohio

[73] Assignee: The Lodge & Shipley Company, Cincinnati, Ohio

[22] Filed: July 8, 1974

[21] Appl. No.: 486,409

[52] U.S. Cl. ..... 294/87 R; 214/1 BT; 214/309; 294/65

[51] Int. Cl.[2] ..... B66C 1/10

[58] Field of Search ..... 214/1 BS, 1 BT, 301, 309, 214/658, 300; 294/87 A, 87 R, 65

[56] References Cited

UNITED STATES PATENTS

| | | | |
|---|---|---|---|
| 2,666,562 | 11/1954 | Birch | 214/309 |
| 2,953,407 | 9/1960 | Cella | 214/309 |
| 3,260,379 | 7/1966 | Bason | 294/65 |
| 3,272,360 | 9/1966 | Schoot | 214/309 |

*Primary Examiner*—Robert J. Spar
*Assistant Examiner*—Lawrence J. Oresky
*Attorney, Agent, or Firm*—Wood, Herron & Evans

[57] ABSTRACT

Apparatus for lifting tightly spaced bottles from cases, spreading the rows of bottles apart and placing the bottles on a bottle conveyor having spaced lanes. The apparatus includes a carriage having a plurality of elongated manifolds, each supporting rows of bottle grippers, the carriage having means for shifting the manifolds laterally with respect to each other to vary the spacing between rows of grippers.

3 Claims, 8 Drawing Figures

CARRIAGE FOR LIFTING AND SPREADING ROWS OF ARTICLES

This invention relates to article handling mechanisms and particularly to apparatus for lifting bottles from cases and depositing the bottles on conveyors which carry the bottles away for further processing. While the invention may have application to any type of article which must be lifted from one position and placed in another position, the invention will be described herein with particular reference to the lifting of bottles from a case and depositing them on a conveyor.

In some bottling operations, as, for example, distilleries, bottles are received from the manufacturer in cases each containing a pattern of three rows of four bottles which are spaced apart in the case by the thickness of the corrugated paperboard dividers in the cases. The bottles must be removed from the cases and place on conveyors where they are conveyed through various processing stations. In some installations the spacing of the rows of bottles upon the conveyor is substantially greater than the spacing between rows in the cases.

Uncasing machinery for lifting bottles from casing and depositing them on conveyors is well known. See, for example, U.S. Pat. Nos. 2,695,190 (Meierjohan) and 3,185,288 (Rowekamp). In such machinery one or more lifting heads is mounted on a carriage for movement between a case conveyor and bottle conveyor. Each lifting head carries a plurality of depending stems, as, for example, flexible pneumatic tubing, each stem having a bottle gripping device at its lower end. The pattern of the stems is fixed to conform to the pattern of bottles found in the cases. While the flexibility of the stems is sufficient to accommodate a slight variation in the spacing of the bottles as between the cases and the carriers on which they are deposited, it is insufficient to pick up bottles which may have a one-fourth inch spacing in the cases and spread them apart into rows which might have as much as an inch of spacing between the rows. Consequently, when bottles are to be taken from cases and placed on such widely spaced rows, it has not been possible to use existing uncasing machinery. Rather, the operations have been performed by hand.

An objective of the present invention has been to provide an apparatus for uncasing tightly spaced bottles and depositing them on widely spaced rows. To this end the invention contemplates a lifting carriage supporting a plurality of elongated manifolds, each manifold carrying a row of grippers. The carriage includes a mechanism for moving at least some of the manifolds laterally with respect to each other as the carriage moves from a first position to a second position in order to expand or contract the spacing between the rows of articles.

In addition to accommodating a spacing difference between the cases and the bottle conveyors, the invention has the advantage of reducing the contact between adjacent bottles which tends to break or scar bottles. The movement of the carriage between cases and bottle conveyors is transverse to the rows of bottles. By increasing the spacing between the rows of bottles immediately upon extracting of the bottles from the cases, the likelihood of bottles banging one another as the carriage swings laterally to the bottle conveyor is greatly decreased.

Another objective of the present invention has been to provide an article lifting carriage of the type described above wherein the grippers supporting manifolds are easily removed from the carriage and replaced, thereby permitting the pattern of bottles to be changed so as to permit the apparatus easily to accommodate bottles of different sizes and pattern spacings.

These and other objectives of the present invention will become more readily apparent from the following detailed description taken in conjunction with the accompanying drawings in which.

Figure 1:
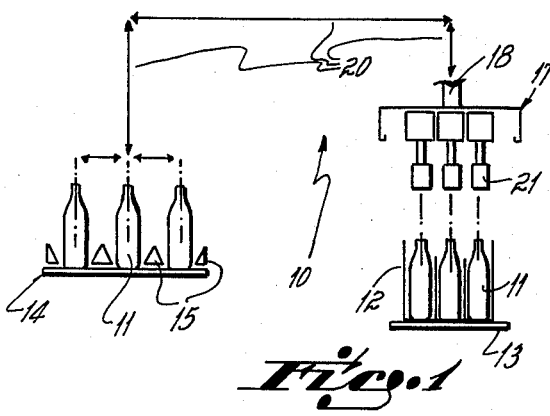
FIG. 1 is a diagrammatic and elevational view of a bottle transfer apparatus construction in accordance with the present invention.
Figure 7:
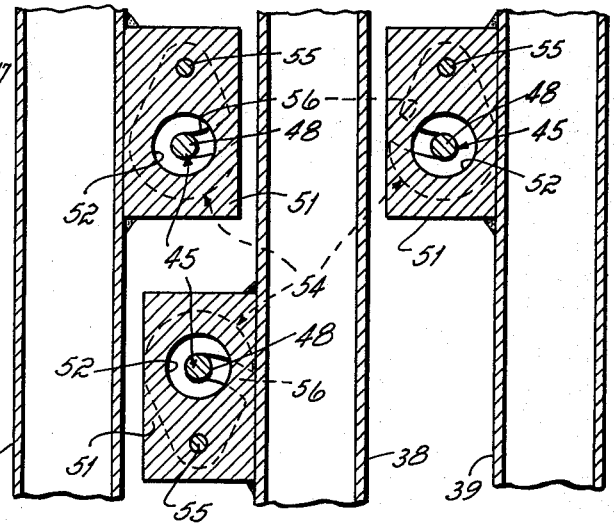
FIG. 7 is a cross sectional view of the carriage taken along lines 7—7 of FIG. 6.

Referring to FIG. 1, there is diagrammatically illustrated at 10 lifting apparatus for removing bottles 11 from cases 13 supported on a case conveyor 13. The bottles 11 are to be deposited on a bottle conveyor 14 having relatively widely spaced guides 15 forming lanes along which the bottles travel for further processing. The guides 15 are preferably triangularly shaped so as to guide the bottles into proper positions, as illustrated, in the lanes.

The mechanism by which the bottles are shifted from the cases 12 to the conveyor 14 includes a carriage 17 supported on brackets 18. Mechanism which is not shown but which is well known causes vertical and transverse movement of the carriage generally as indicated by the arrows 20. Thus, the carriage is lowered toward the case 12 to receive the bottles. The carriage then rises to remove the bottles from the case 12 and then moves transversely to overlie the conveyor 14. The carriage then descends to deposit the bottles 11 onto the conveyor 14.

The carriage supports at least one pattern of bottle grippers 21 which may be of the type shown in U.S. Pat. No. 2,873,996. It should be understood that the invention is suitable for use with any type of article gripper, the article gripper being selected to accommodate it to the particular article being handled by the apparatus.

In the illustrated form of the invention the bottles in each case are in a pattern of three rows, each row having four bottles. The pattern of the grippers 21 is the same as the pattern of the bottles in the case. Further, in the illustrated form of the invention the lifting carriage supports four such patterns so that four cases can be uncased with each cycle of the apparatus 10. While four patterns are illustrated, it should be understood that the invention is equally applicable to any number of patterns.

Figure 2:
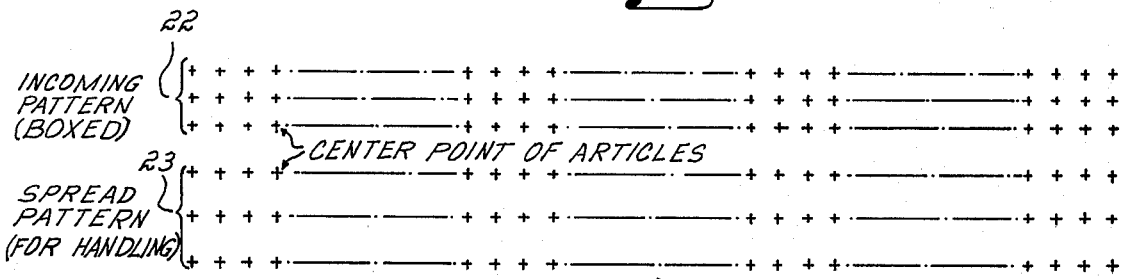
FIG. 2 is a diagrammatic view of the change in the pattern of bottles between cases and bottle conveyor.

From FIG. 1 it can be seen that the rows of bottles 11 are quite closely spaced in the incoming cases 12. On the other hand, the bottles on the conveyor 14 are spaced apart by a distance several times the spacing of the cased bottles. The apparatus is designed to accommodate this difference in spacing so that, as illustrated in FIG. 2, the bottles may be lifted from a tightly spaced pattern 22 (out of the case) and deposited in widely spaced apart rows 23 (onto the conveyor). The mechanism by which the spacing of the bottles is effected is illustrated in FIGS. 3-8.

Figure 6:
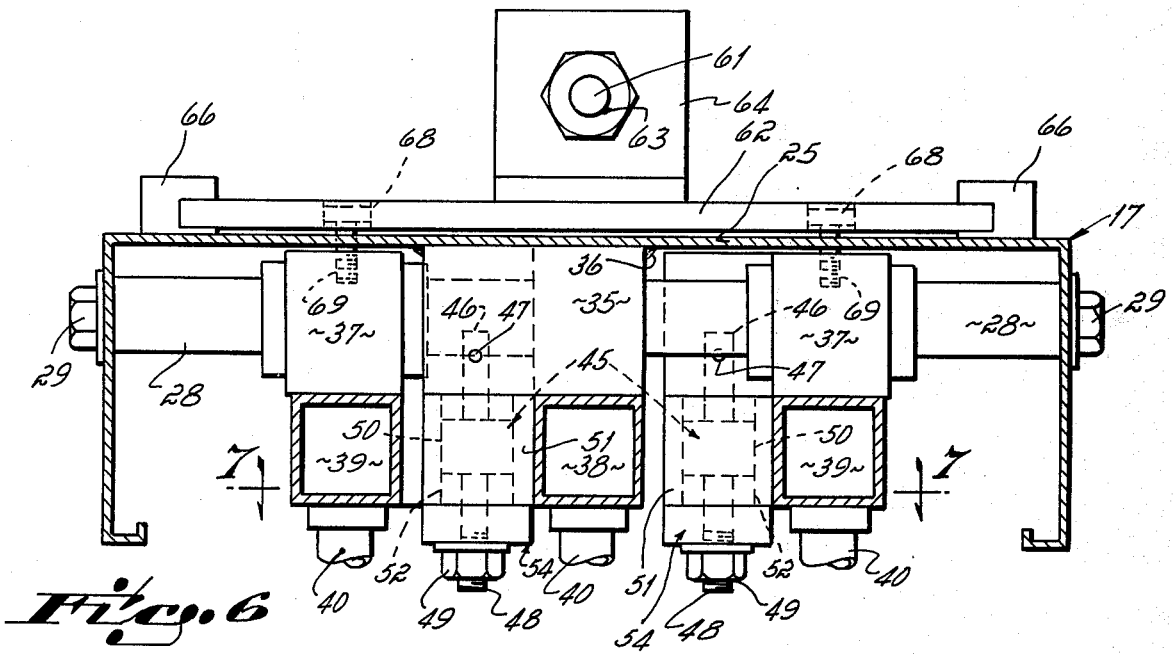
FIG. 6 is a cross sectional view of the carriage taken along lines 6—6 of FIG. 5.
Figures 3, 4, 5:
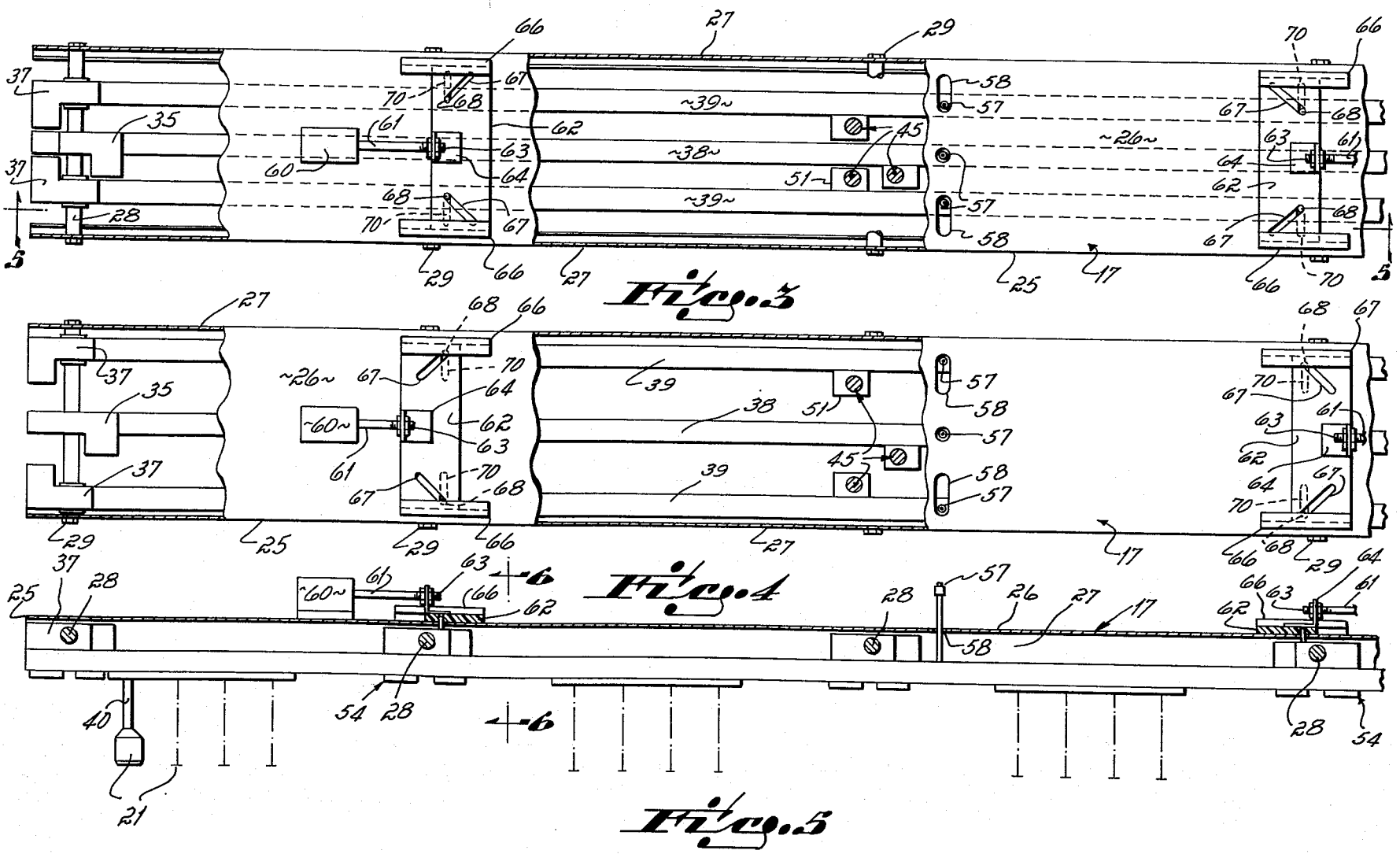
FIG. 3 is a top plan view with portions broken away of the carriage of the present invention.
FIG. 4 is a view similar to FIG. 3 showing a shifted position of the carriage manifolds.
FIG. 5 is a cross sectional view of the carriage taken along lines 5—5 of FIG. 3.
Figure 8:
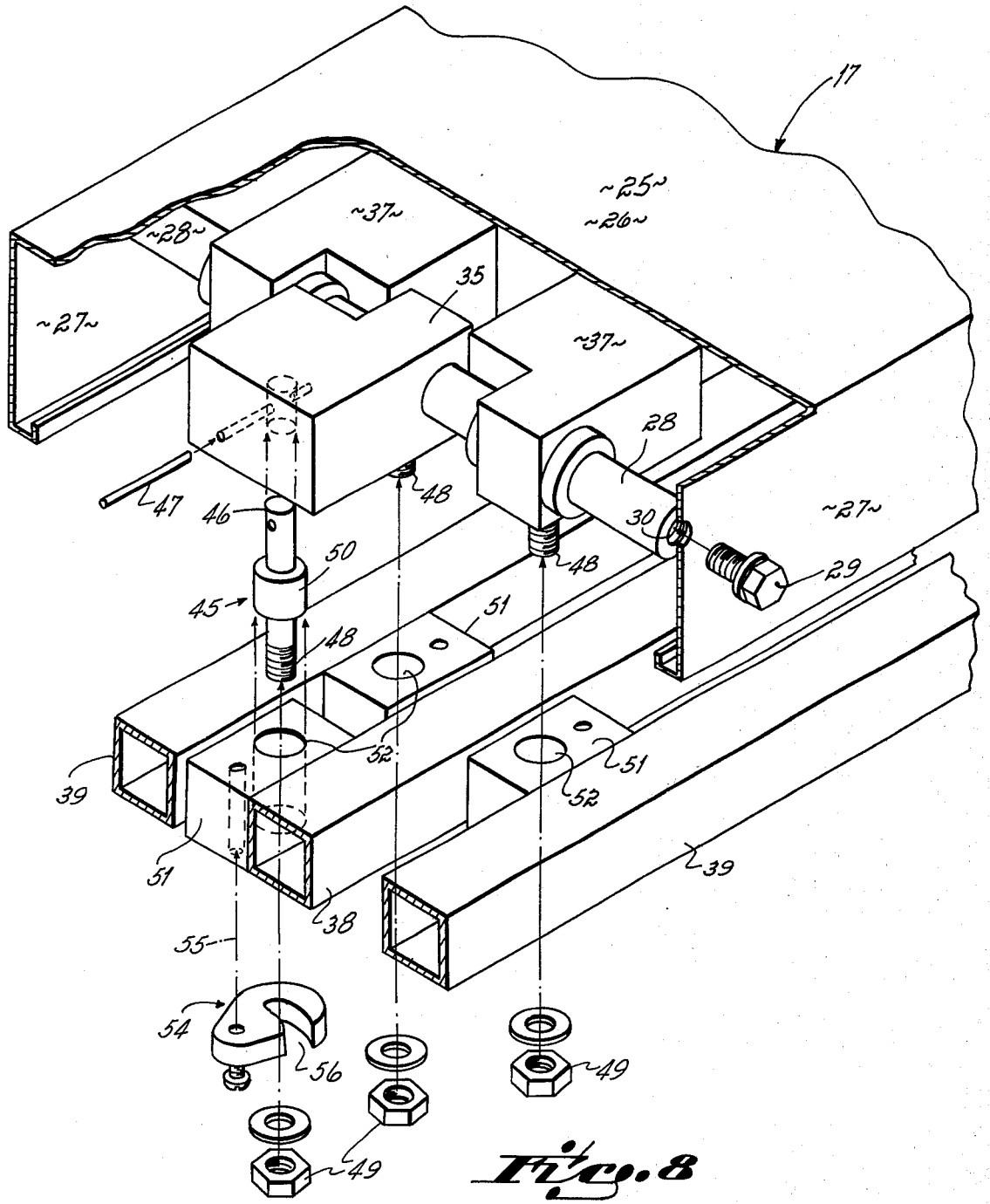
FIG. 8 is an exploded perspective view of a portion of the carriage illustrating a typical mounting for the manifolds.

Referring to FIGS. 3 and 6, the carriage 17 includes an elongated channel-shaped shroud 25 providing a horizontal flat plate 26 and depending flanges 27. The shroud is provided with suitable brackets to enable it to be mounted to the brackets 18 of the bottle handling apparatus. Five transverse rods 28 are supported between the flanges 27, the bars being secured to the flanges 27 by machine screws 29 threaded into threaded bores 30 at the ends of the rods 28. The five rods 28 are uniformly spaced along the length of the shroud.

Each rod passes through a fixed block 35 which is welded as at 36 to the undersurface of the shroud and thus forms a partial support for the rod 28. Two outboard blocks 37 are slidable on the rod 28. The blocks 35 and 37 support a central manifold 38 and lateral manifolds 39, respectively. Each manifold supports a row of flexible tubing 40, to each of which tube is attached the bottle gripper 21 (FIG. 5). The manifolds and tubes form the passageways for applying air to the grippers to operate them. In the illustrated form of the invention which contemplates four patterns of 4 × 3, each manifold supports a row of grippers consisting of four groups of four grippers.

The mainfolds 38 and 39 are removably supported on their blocks so that they can be changed to alter the pattern of the grippers. The mainfold mounting is formed by a pin 45 which is secured at its upper end 46 by a roll-pin 47 to the block 35 or 37. At its lower end 48 the pin is threaded to receive a nut 49. Intermediate the ends 46 and 47 is a large diameter land 50.

Each manifold has a mounting block 51 welded to it for each of the five mounting positions. The mounting block has a bore 52 which is sized to slidably received the land 50 of the pin 45. A hook 54 is pivotally mounted by a pin 55 to the mounting block. The hook has an arucate slot 56 adapted to receive the lower end 48 of the pin 45 to lock the manifold into position.

The outboard manifolds are shiftable laterally by a pair of double-acting cylinders 60, each carrying a piston having a projecting rod 61. The rod 61 of each cylinder 60 is connected to a cam plate 62 by connecting a threaded end 63 to a bracket 64 projecting upwardly from the cam plate 62. The cam plate 62 is slidably mounted in ways 66 at each side of the shroud 25. Each plate has two angulated slots 67 which receive a pin 68 forming a cam follower. The pin 68 is threaded at its lower end 69 and is secured to a threaded bore in the slidable blocks 37. The pin also projects through a transverse slot 70 in the shroud which blocks longitudinal movement of the manifolds and permits only lateral movement.

Each manifold is provided with a quick disconnect fitting 57 which projects upwardly through a hole 58 in the shroud. The size of the hole 58 is such to permit the manifold and the fitting to move laterally during the operation of the invention.

The combination of the mounting hooks 54 and the quick disconnect fittings enables the manifolds to be removed and replaced to set up a different carriage pattern for incoming cases of bottles. If the lateral spacing of the incoming bottles in their cases is different, the cam plates 62 may also be replaced to provide a cam plate having a different slot configuration which will change the extent of the lateral positioning of the manifolds in their contracted position. Preferably, the cam plates and manifolds in a set have identical distinguishing colors to facilitate assembly.

Referring to FIGS. 3 and 4, it can be seen that when the rod 61 is in its fully extended position, the pins 68 have been cammed inwardly to contract the spacing between adjacent manifolds. As shown in FIG. 4, when the rod 61 is withdrawn into the cylinder 60, the pins are cammed outwardly to expand the spacing between adjacent manifolds. When the manifolds are in the contracted condition illustrated in FIG. 3, the spacing of the grippers is such as to enable the grippers to engage closely spaced bottles in a case. As soon as the bottles are lifted from the case, pneumatic pressure is applied to the cylinders 60 to retract the rods 61, thereby causing the manifolds to move laterally and to expand the spacing between the grippers. In this condition, the bottles may be swung over to the conveyor 14 and deposited between the guides 15.

It should be understood that while the illustrated form of the invention has a stationary center manifold and two laterally movable manifolds, the invention is applicable to other patterns as, for example, four laterally movable manifolds supporting four rows of grippers. Such differing patterns can be accommodated simply by modifying the cam plate and cooperating pins carried by the manifolds to program any desired movement into any desired number of manifolds.

I claim:

1. A lifting carriage for plural patterns of articles comprising, an elongated channel-shaped shroud including a flat top plate and depending lateral flanges, a plurality of transverse rods supported between said flanges, a plurality of elongated manifolds slidably mounted on said rods for lateral movement, each manifold having plural sets of grippers, each set of grippers on a manifold being spaced longitudinally from the adjacent set and aligned transversely with grippers on adjacent manifolds to provide plural patterns of grippers longitudinally spaced along said shroud, each said manifold having two upwardly projecting pins, said top plate having a transverse slot receiving each said pin, two cam plates mounted for longitudinal movement on said shroud and having angulated cam slots receiving said pins to effect lateral movement of said manifolds upon longitudinal movement of said cam plate, a longitudinally oriented piston and cylinder mounted on said shroud and connected to each said cam plate to thrust said cam plate longitudinally in one direction to spread said manifolds, and in other direction to retract said manifolds.

2. A carriage as in claim 1 further comprising, a central, longitudinally extending manifold fixed to said shroud, said slidable manifolds consisting of a manifold on each side of said central manifold.

3. A carriage as in claim 1 further comprising, a plurality of bearing blocks mounted on said transverse rods, means detachably connecting said manifolds to said bearing blocks to mount said manifolds on said transverse rods to permit interchange of manifolds with other manifolds, thereby permitting one carriage to accommodate a plurality of patterns and types of grippers.

* * * * *